United States Patent [19]

Schmid

[11] 3,978,691

[45] Sept. 7, 1973

[54] DUST REMOVING APPARATUS FOR THE NEEDLES OF A WARP KNITTING MACHINE

[75] Inventor: Reinhold Schmid, Rheydt, Germany

[73] Assignee: W. Schlafhorst & Co., Monchengladbach, Germany

[22] Filed: Nov. 19, 1973

[21] Appl. No.: 417,378

[30] Foreign Application Priority Data

Nov. 18, 1972 Germany ..... 2256729

[52] U.S. Cl. ..... 66/168; 66/208

[51] Int. Cl.[2] ..... D04B 35/32

[58] Field of Search ..... 66/86 R, 168, 86 B, 66/86 F

[56] References Cited

UNITED STATES PATENTS

| | | | |
|---|---|---|---|
| 2,400,741 | 5/1946 | Christensen et al. | 66/168 |
| 2,699,658 | 1/1955 | Peters | 66/86 R |
| 3,405,543 | 10/1968 | Diehl | 66/86 R |
| 3,461,693 | 8/1969 | Klaevi | 66/168 |
| 3,857,260 | 12/1974 | Zwingenberger et al. | 66/86 R |

FOREIGN PATENTS OR APPLICATIONS

| | | | |
|---|---|---|---|
| 1,061,943 | 9/1956 | Germany | 66/168 |

*Primary Examiner*—Mervin Stein
*Assistant Examiner*—Andrew M. Falik
*Attorney, Agent, or Firm*—Herbert L. Lerner

[57] ABSTRACT

Means for eliminating dust in the knitting zone and at the latch needles of warp knitting machines with a casting-off bar and casting-off comb plates. Contoured stripping plates are mounted on the casting-off comb plates. The stripping plates are led through the spaces between the knitting needles. Cleaning air is supplied through ducts to assist the stripping action.

5 Claims, 7 Drawing Figures

DUST REMOVING APPARATUS FOR THE NEEDLES OF A WARP KNITTING MACHINE

BACKGROUND OF THE INVENTION

The invention concerns means for removing dust in the knitting zone and at the knitting or latch needles of warp knitting machines with a casting-off bar consisting of casting-off comb plates.

By means of the invention, dust accumulations in the area of the latch needles are prevented during the operation of the machine, and deposits of fuzz are removed.

In circular knitting machines it is known to direct crosswise intersecting streams of compressed air into the gap between the needle cylinder and the dial as well as against the dial needle bed, where the compressed air must be conducted to individual cleaning points through lines ending in nozzles from which issue the intersecting streams of compressed air. Attaching additional elements such as hose, tubes or the like, however, causes substantial expenditures and forms new contours at the otherwise smooth surfaces of such machines, at which dust and fuzz can again accumulate. Furthermore, it has been found in practice that applying a stream of compressed air to the needle zone alone is not sufficient for the effective removal of dust.

SUMMARY OF THE INVENTION:

It is an object of the invention to avoid the disadvantages described above in a device for eliminating dust in the knitting zone and at the latch needles of warp knitting machines. To solve this problem, the invention utilizes the idea of using certain existing components for wiping off the dust particles and other components for conducting the air of one or several air blasts.

The solution of the problem according to the present invention is that the casting-off comb plates are provided with contoured stripping plates which are led through the spaces between the knitting needles. Another feature of the present invention is that the mounts for the casting-off comb plates are provided with canals running parallel to the row of knitting needles as well as with air duct orifices arranged at right angles thereto for streams of cleaning air which pass through the casting-off comb plates and are directed onto the knitting zone and the knitting needles.

The effectiveness of the dust removal is substantially improved by the combination of the mechanical wiping-off and the cleaning.

According to a further feature of the invention, it is particularly advantageous for the feeding of a cleaning air stream, if a space situated between the profile forming the casting-off edge and the mountings for the casting-off comb plates is designed as a channel to supply a stream of blowing air. A profiled bar forming the casting-off edge is provided in the area of the casting-off edge with air discharge openings directed toward the knitting zone and the knitting needles.

By modifying already existing components for carrying the air, separate and additional pipe lines become unnecessary in the area of the latch needles and of the knitting zone, and therefore, in the dust-generating area. The air cleaning of the latch needles can, of course, be controlled in such a manner that a stream of air is effective continuously as well as in predetermined time intervals. The air stream can furthermore be enriched with solvents which dissolve the oil or fat component of the fibers and in this manner counteract coalescence and the formation of fiber clusters.

Other features which are considered as characteristic for the invention are set forth in the appended claims.

Although the invention is illustrated and described herein as embodied in a knitting machine it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings in which.

Figure 1:
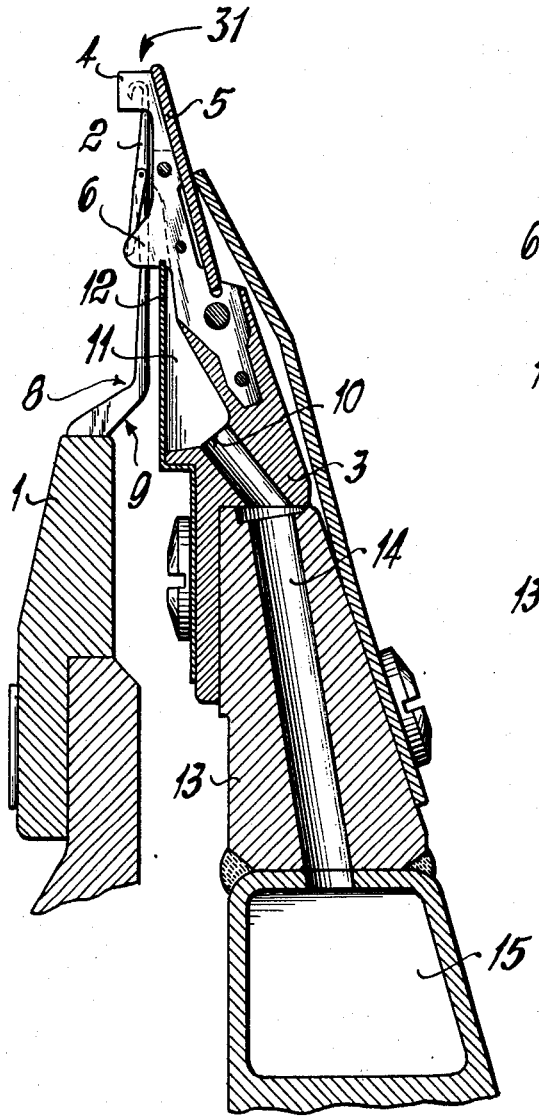
FIG. 1 is a side view of a needle-and a casting-off bar consisting of casting-off comb plates, in cross-section.

DESCRIPTION OF THE PREFERRED EMBODIMENTS:

In the embodiment shown in FIG. 1, a needle bar 1 with knitting needles 2 will be seen, which are here designed as latch needles. The mount 3 of the casting-off bar mounts individual casting-off comb plates 4 as well as steel strip 5, which forms the casting-off edge. Individual casting-off comb plate 4 and contoured stripping plate 6 are attached to plate member 31. All the casting-off comb plates 4 are provided with contoured stripping plates 6, which extend during operation, through spaces 7 between the knitting needles 2 and ensure with each lifting motion of the knitting needles 2, the stripping off of dust or fuzz, particularly in the regions 8 and 9. Thus the relative upwards motion of the latch needles to the stripping plates extending through the spaces between the latch needles results in relative downwards motion of said stripping plates to strip away dust from the shank of the needles. As an aid for this wiping-off action of the contoured stripping plates 6, a stream of cleaning air is directed in addition toward the knitting needles 2 i.e. the stream of cleaning air extends across the needles 2 to aid in removing dust.

For this purpose, the mounting 3 is provided with an air duct orifice 10, which at one end opens into a canal 11 which extends over the entire width of the mounting 3 and is diverted and guided by the cover plate 12. At its other end, it is connected with airducts 14 which go through the carrier 13. The airducts 14 of the carrier 13 of a complete casting-off bar open into the air supply channel 15, which extends across the entire width of the machine and to which is connected a device, not shown, for generating the stream of cleaning air.

Figure 2:
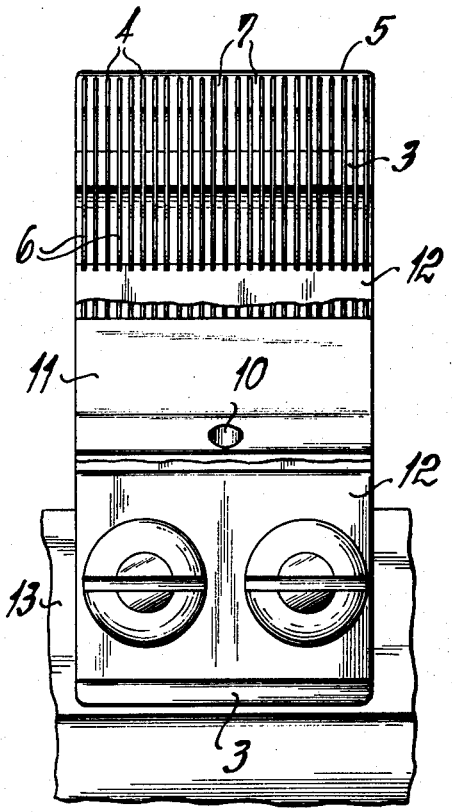
FIG. 2 is a partial front view of FIG. 1.

FIG. 2 shows a mounting 3 with the individual casting-off comb plates 4. The needle bar 1 with the knitting needles 2 is not shown in FIG. 2 for the sake of greater clarity. At the mounting 3, one will see again particularly clearly the air duct orifice 10, which opens into the channel 11.

Figure 3:
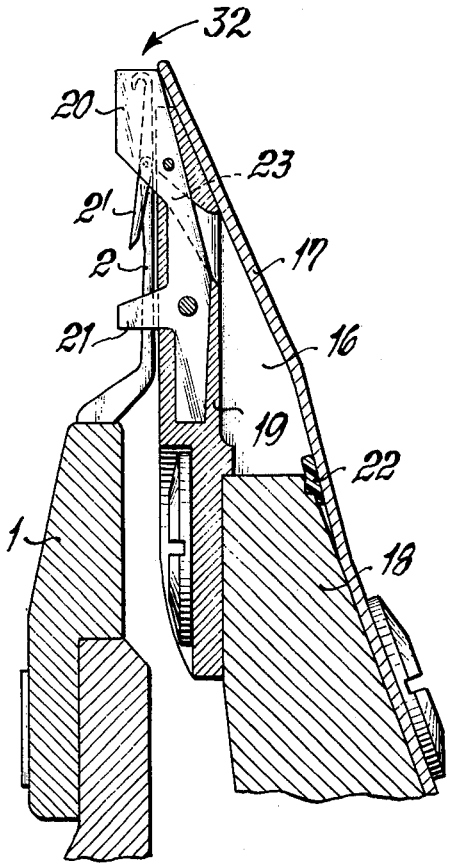
FIG. 3 is a side view of another needle-and casting-off bar showing casting-off comb plates, in cross-section.

In the embodiment shown in FIG. 3, a channel 16 for blowing air is formed by the profile 17 forming the casting-off edge, the longitudinal beam 18 and the back side of the mounting 19. A sealing strip 22 is inserted between the profile 17 and the longitudinal beam 18. On the mounting 19 are mounted individual casting-off comb plates 20 with contoured stripping plates 21, which protrude between the knitting needles 2. Individual casting-off comb plate 20 and contoured stripping plate 21 are attached to plate member 32. The cleaning air flowing through the channel 16 strikes the knitting needles 2, through an opening 23 of aerodynamically advantageous shape, at their lowest position in the region of the latches 2'.

Figure 4:
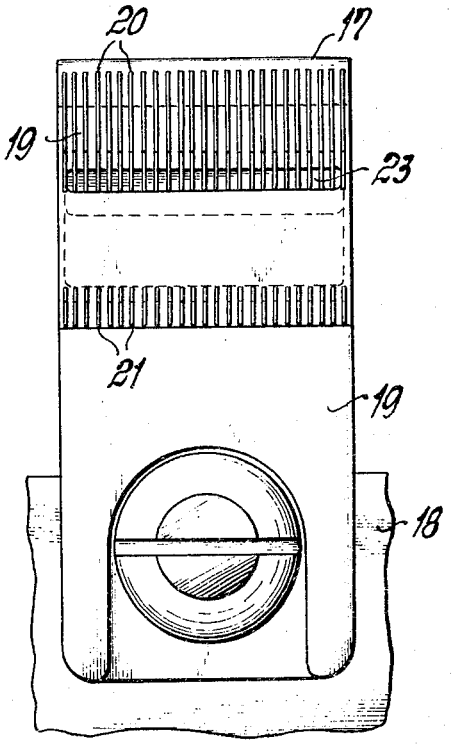
FIG. 4 is a partial front view of FIG. 2.

FIG. 4 shows the opening 23 for the cleaning air stream in the mounting 19 which mounts individual casting-off comb plates 20.

Figure 5:
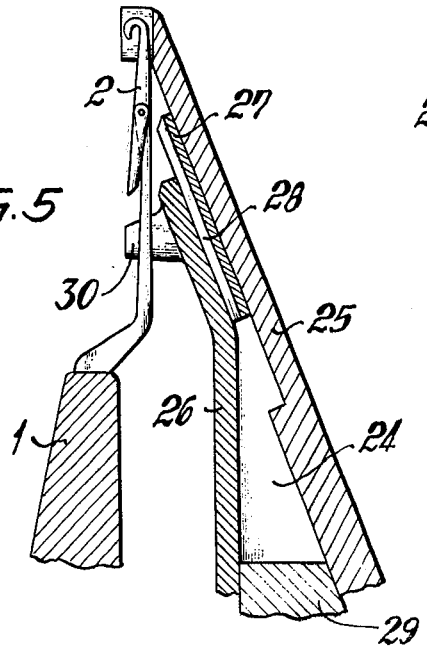
FIG. 5 is a side view of another needle-and casting-off bar, in cross-section.
Figure 6:
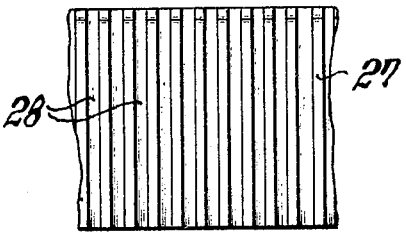
FIG. 6 is a partial front view of the casting-off bar of FIG. 5.
Figure 7:
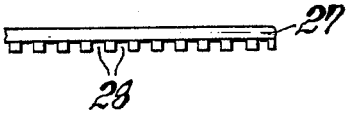
FIG. 7 is a top view of FIG. 6.

FIG. 5 shows another embodiment of a casting-off bar having a channel 24 which consists of a profiled strip 25. The cross section of channel 24 is formed by the profiled strip 25 and by a cover plate 26 and the longitudinal beam 29. The cover plate 26 has contoured stripping plates 30, which protrude between the individual spaces between the needles. Between the profiled bar 25 and the cover plate 26 is clamped a serrated strip 27, whose air discharge openings 28, which are shown in FIGS. 6 and 7, divide the cleaning air stream and direct it against the individual knitting needles 2. The pitch of the air discharge openings 28 in the strip 27 can be matched to the respective pitch of the needles. The air discharge openings 28 can, of course, also be machined directly out of the profiled bar 25, so that a separate strip 27 becomes unnecessary.

I claim:

1. Means for removing dust in the knitting zone and at the latch needles of a warp knitting machine having at least one casting off bar comprising a plate member on which there are mounted at separate locations a casting off comb plate and a contoured stripping plate with a protruding portion of said stripping plate extending through the spaces between the latch needles, whereby the relative vertical motion between said plate member and said latch needles results in waste being stripped away from the shanks of the needles by said protruding portion, and means for directing a stream of cleaning air to extend across said latch needles and in an upward direction to at least the latches of said latch needles.

2. Means according to claim 1 wherein the mounting for the casting-off comb plates are provided with canals running parallel to the row of latch needles, air stream directing means comprising air duct openings formed in said canals and arranged for streams of cleaning air which pass between the casting-off comb plates and are directed onto the knitting zone and the latch needles.

3. Means according to claim 1 wherein said air stream directing means comprises a channel bounded in part by the mounting for the casting-off comb plates.

4. Means according to claim 3, wherein a profiled bar forming the casting-off edge is provided in the area of the casting-off edge with air discharge openings directed onto the knitting zone and the latch needles.

5. Means as in claim 2 wherein said air stream directing means comprises a channel bounded in part by the mounting for the casting-off comb plates.

* * * * *

UNITED STATES PATENT AND TRADEMARK OFFICE

CERTIFICATE OF CORRECTION

PATENT NO. : 3,978,691

DATED : September 7, 1976

INVENTOR(S) : Reinhold Schmid

It is certified that error appears in the above-identified patent and that said Letters Patent are hereby corrected as shown below:

In the heading of the Letters Patent, second line,

[45] the date should read: Sept. 7, 1976

Signed and Sealed this

Fifth Day of April 1977

[SEAL]

*Attest:*

RUTH C. MASON
*Attesting Officer*

C. MARSHALL DANN
*Commissioner of Patents and Trademarks*